US008395095B2

(12) United States Patent
Yeh et al.

(10) Patent No.: US 8,395,095 B2
(45) Date of Patent: Mar. 12, 2013

(54) ELECTROTHERMAL TRANSFER DEVICE AND ELECTROTHERMAL TRANSFER METHOD

(75) Inventors: Chia-Chun Yeh, Hsinchu (TW); Yao-Chou Tsai, Hsinchu (TW); Henry Wang, Hsinchu (TW); Sung-Hui Huang, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 2 days.

(21) Appl. No.: 13/090,773

(22) Filed: Apr. 20, 2011

(65) Prior Publication Data

US 2012/0168428 A1 Jul. 5, 2012

(30) Foreign Application Priority Data

Dec. 31, 2010 (TW) ..... 99147339 A

(51) Int. Cl.
*H05B 3/02* (2006.01)
*H05B 1/00* (2006.01)

(52) U.S. Cl. ..... 219/546; 219/216; 219/483; 219/486; 219/501; 219/502; 219/497; 219/543

(58) Field of Classification Search ..... 219/546, 219/216, 483, 486, 501–2, 497, 543
See application file for complete search history.

(56) References Cited

U.S. PATENT DOCUMENTS 5,783,805 A * 7/1998 Katzmann ..... 219/494

* cited by examiner

*Primary Examiner* — Shawntina Fuqua
(74) *Attorney, Agent, or Firm* — WPAT PC; Justin King

(57) ABSTRACT

An electrothermal transfer device includes a substrate, a plurality of electrothermal components and a heating circuit. The electrothermal components are disposed on a surface of the substrate and arranged in a pattern. The heating circuit is electrically connected to the electrothermal components. In an electrothermal transfer method, at first, a transfer substrate is disposed on a workpiece substrate. Then, the electrothermal transfer device is disposed on the transfer substrate so that the electrothermal components contact with the transfer substrate. Thereafter, the heating circuit is used to heat the electrothermal transfer components so that the transfer substrate is heated to be transferred to the workpiece substrate. The electrothermal transfer device and the electrothermal transfer method can reduce cost.

19 Claims, 4 Drawing Sheets

200(200a, 200b)

ELECTROTHERMAL TRANSFER DEVICE AND ELECTROTHERMAL TRANSFER METHOD

FIELD OF THE INVENTION

The present invention relates to a thermal transfer technology, and more particularly to an electrothermal transfer device and an electrothermal transfer method.

BACKGROUND OF THE INVENTION

Laser thermal transfer is a typical thermal transfer technology. Generally, a laser thermal transfer device is equipped with a high precision laser optical system and a high accuracy movable carrier. Purchase cost and maintenance cost of components of the high precision laser optical system and the high accuracy movable carrier are usually expensive. Therefore, considering the production cost, the laser thermal transfer is not suitable for a large area thermal transfer.

Further, the laser thermal transfer generally applies a color donor including a light sensitive material. When the color donor is prepared, it is necessary to consider the absorbing laser ability and the light thermal conversion ability of various components of the color donor, the characteristics of light sensitive material, and the interactive relationships of the light sensitive material, paints, dyes, and thermal desorption materials in the color donor. Thus, the color donor applied by the laser thermal transfer has complex compositions, thereby having a high production cost. Therefore, the use of the laser thermal transfer can not reduce the production cost effectively.

SUMMARY OF THE INVENTION

Therefore, the present invention provides an electrothermal transfer device, which has a simple structure, low manufacturing cost and low maintenance cost.

The present invention provides an electrothermal transfer method, which can be applied to a large area thermal transfer, thereby reducing production cost.

The present invention provides an electrothermal transfer device includes a substrate, a plurality of electrothermal components and a heating circuit. The electrothermal components are disposed on a surface of the substrate and arranged in a pattern. The heating circuit is electrically connected to the electrothermal components.

In one embodiment of the present invention, a material of the electrothermal components is selected from a group consisting of metal, metal oxide and graphite.

In one embodiment of the present invention, a material of the heating circuit is either metal or metal oxide.

In one embodiment of the present invention, the heating circuit is disposed on the surface of the substrate.

In one embodiment of the present invention, the substrate is a roller, and the surface of the substrate is a circumferential surface of the roller.

In one embodiment of the present invention, the substrate is a plate, and the surface of the substrate is a planar surface of the plate.

In one embodiment of the present invention, the electrothermal transfer device further includes an aligning unit connected to the substrate.

The present invention also provides an electrothermal transfer method using the above mentioned electrothermal transfer device. The electrothermal transfer device includes a substrate, a plurality of electrothermal components and a heating circuit. The electrothermal components are disposed on a surface of the substrate and arranged in a pattern. The heating circuit is electrically connected to the electrothermal components. In the electrothermal transfer method, at first, a transfer substrate is disposed on a workpiece substrate. Then, the electrothermal transfer device is disposed on the transfer substrate so that the electrothermal components contact with the transfer substrate. Thereafter, the heating circuit is used to heat the electrothermal components so that the transfer substrate contacted with the electrothermal components is heated to be transferred onto the workpiece substrate.

In one embodiment of the present invention, the transfer substrate is a color donor substrate.

In one embodiment of the present invention, the color donor substrate includes a base film, a heat sensitive peeling layer and a colorant layer. The base film is contacted with the electrothermal components, the colorant layer covers and is contacted with the workpiece substrate, and the heat sensitive peeling layer is between the base film and the colorant layer.

In one embodiment of the present invention, the transfer substrate is an electron or hole substrate.

In one embodiment of the present invention, the electron or hole substrate includes a base film, a heat sensitive peeling layer and an electron or hole injection layer. The base film is contacted with the electrothermal components, the electron or hole injection layer covers and is contacted with the workpiece substrate, and the heat sensitive peeling layer is between the base film and the electron or hole injection layer.

In one embodiment of the present invention, the substrate is a roller, and the surface of the substrate is a circumferential surface of the roller. When the heating circuit is used to heat the electrothermal components, the roller is rotated.

In one embodiment of the present invention, the substrate is a plate, and the surface of the substrate is a planar surface of the plate.

In one embodiment of the present invention, the workpiece substrate is either a thin film transistor liquid crystal display (TFTLCD) substrate or an organic light emitting display (OLED) substrate.

In one embodiment of the present invention, the workpiece substrate is either a glass substrate or a plastic substrate.

In one embodiment of the present invention, the electrothermal transfer device further includes an aligning unit connected to the substrate, and the electrothermal transfer method further includes a step of controlling the aligning unit to adjust a relative position of the electrothermal components to the workpiece substrate.

In the present invention, an electrothermal transfer technology is applied. The electrothermal transfer device utilities the heating circuit to heat the electrothermal components arranged in the pattern so that the transfer substrate contacted with the electrothermal components is heated to be transferred onto the workpiece substrate. The structure of the electrothermal transfer device is simple so that the electrothermal transfer device has low manufacturing cost and low maintenance cost. The electrothermal transfer method using the electrothermal transfer device can be applied to a large area thermal transfer, thereby reducing production cost.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
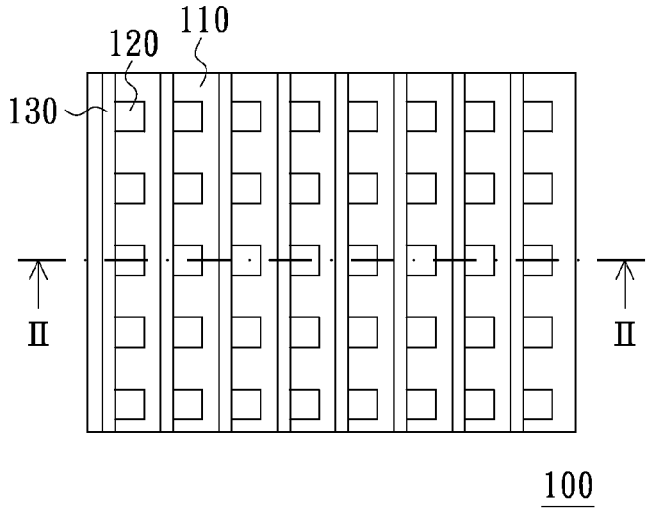
FIG. 1 illustrates a schematic, top view of an electrothermal transfer device in accordance with a first embodiment of the present invention.
Figure 2:
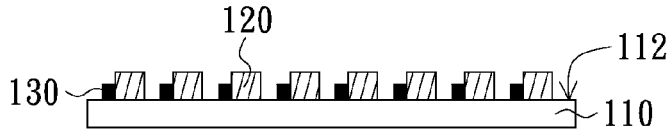
FIG. 2 illustrates a schematic, cross-sectional view of the electrothermal transfer device shown in FIG. 1 along a line II-II.

FIG. 1 illustrates a schematic, top view of an electrothermal transfer device in accordance with a first embodiment of the present invention. FIG. 2 illustrates a schematic, cross-sectional view of the electrothermal transfer device shown in FIG. 1 along a line II-II. Referring to FIG. 1 and FIG. 2, an electrothermal transfer device 100 includes a substrate 110, a plurality of electrothermal components 120 disposed on the substrate 110 and a heating circuit 130.

The substrate 110 has a surface 112. In the present embodiment, the substrate 110 is a plate, and the surface 112 of the substrate 110 is a planar surface of the plate.

The electrothermal components 120 are disposed on the surface 112 of the substrate 110 and arranged in a pattern. In the present embodiment, the electrothermal components 120 are arranged in an array. It is noted that, the arrangement pattern of the electrothermal components 120 can be designed according to different transfer demand and is not limited by the present embodiment. A material of the electrothermal components 120 can be selected from a group consisting of metal, metal oxide and graphite. For example, the electrothermal components 120 can be made of metal such as chromium (Cr), aluminum (Al), iron (Fe), Nickel (Ni), or molybdenum (Mo). The electrothermal components 120 can be made of metal oxide such as indium tin oxide (ITO), indium zinc oxide (IZO), aluminum doped zinc oxide (AZO), or indium gallium zinc oxide (IGZO).

The heating circuit 130 is electrically connected to the electrothermal components 120 and an electric power source (not shown). Each of the electrothermal components 120 is heated through the heating circuit 130. In the present embodiment, in order to manufacture the heating circuit 130, the heating circuit 130 is directly disposed on the surface 112 of the substrate 110. It is noted that, the heating circuit 130 can also be disposed inside the substrate 110. A material of the heating circuit 130 can be either metal or metal oxide. For example, the electrothermal components 120 can be made of metal such as chromium (Cr), aluminum (Al), iron (Fe), Nickel (Ni), or molybdenum (Mo). The electrothermal components 120 can be made of metal oxide such as indium tin oxide (ITO), indium zinc oxide (IZO), aluminum doped zinc oxide (AZO), or indium gallium zinc oxide (IGZO).

Figure 3:
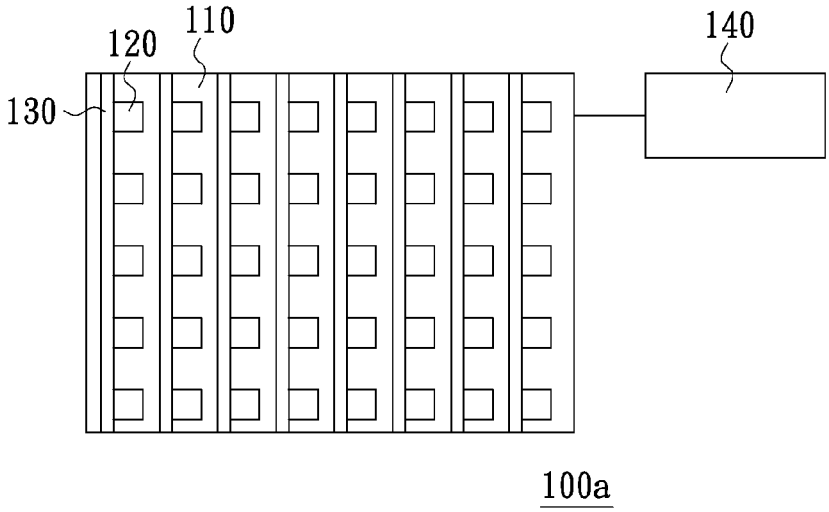
FIG. 3 illustrates a schematic, top view of an electrothermal transfer device in accordance with a second embodiment of the present invention.

FIG. 3 illustrates a schematic, top view of an electrothermal transfer device in accordance with a second embodiment of the present invention. Referring to FIG. 3, in the present embodiment, the electrothermal transfer device 100*a* is similar to the electrothermal transfer device 100 in the first embodiment except that the electrothermal transfer device 100*a* further includes an aligning unit 140 connected to the substrate 110. The aligning unit is configured for moving the substrate 110 so as to adjust a relative position of the electrothermal components 120 to a workpiece substrate. The aligning unit 140 is a familiar technology and is not described here.

Figure 4:
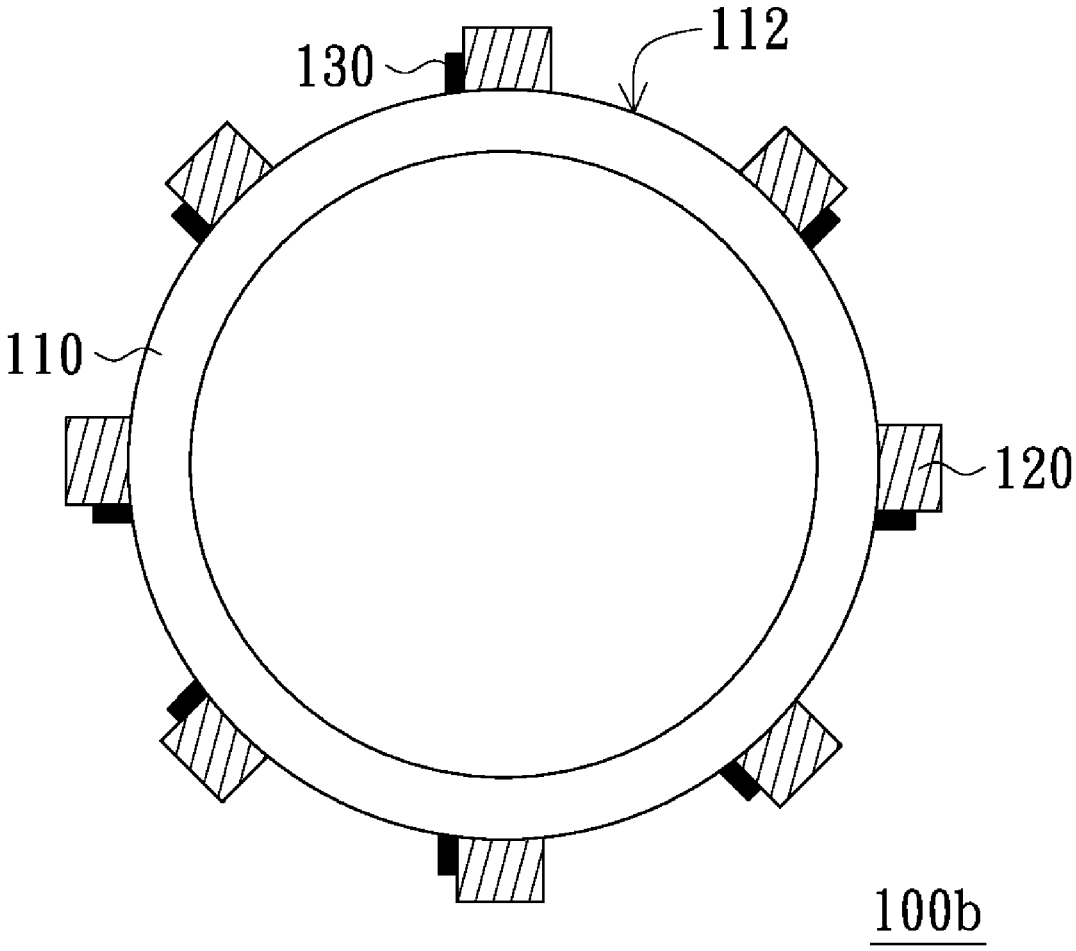
FIG. 4 illustrates a schematic view of an electrothermal transfer device in accordance with a third embodiment of the present invention.

FIG. 4 illustrates a schematic view of an electrothermal transfer device in accordance with a third embodiment of the present invention. Referring to FIG. 4, in the present embodiment, the electrothermal transfer device 100*b* is similar to the electrothermal transfer device 100 in the first embodiment except that the substrate 110 of the electrothermal transfer device 100*b* is a roller, and the surface 112 of the substrate 110 is a circumferential surface of the roller. The electrothermal transfer device 100*b* in the present embodiment is suitable for a roll-to-roll thermal transfer process and can facilitate the development of flexible components.

FIG. 5A to FIG. 5D illustrate a process flow of an electrothermal transfer method using the electrothermal transfer device in second embodiment of the present invention. In the present embodiment, an electrothermal transfer method is used to, for example, but not limited to, fabricate a color filter layer. The electrothermal transfer method includes the following steps.

Figure 5A:
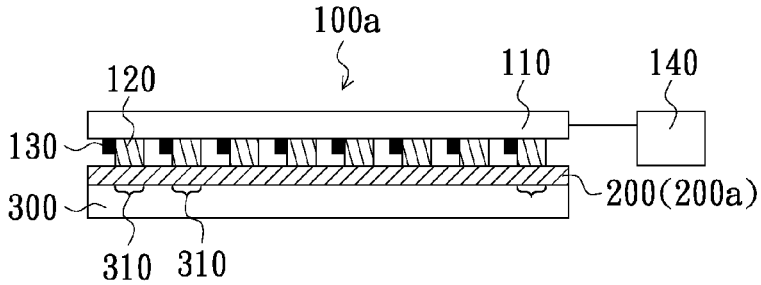
FIG. 5A to FIG. 5D illustrate a process flow of an electrothermal transfer method using the electrothermal transfer device in second embodiment of the present invention.
Figure 6:
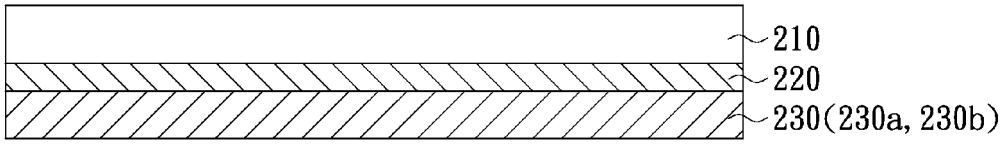
FIG. 6 illustrates a schematic, cross-sectional view of a transfer substrate.

In the electrothermal transfer method, at first, referring to FIG. 5A, a transfer substrate 200 is disposed on a workpiece substrate 300. In the present embodiment, the transfer substrate 200 is a color donor substrate. FIG. 6 illustrates a schematic, cross-sectional view of a transfer substrate. Referring to FIG. 5A and FIG. 6, the transfer substrate 200 includes a base film 210, a heat sensitive peeling layer 220 and a colorant layer 230. The heat sensitive peeling layer 220 is located between the base film 210 and the colorant layer 230. The colorant layer 230 covers and is contacted with the workpiece substrate 300. In the present embodiment, the workpiece substrate 300 can be either a glass substrate or a plastic substrate. The workpiece substrate 300 has a plurality of first predetermined regions 310. The first predetermined regions 310 are regions where a plurality of red filter patterns will be formed. In other words, the electrothermal components 120 are arranged corresponding to the red filter patterns to be formed. In the present embodiment, because the red filter patterns of the color filter layer are firstly formed, the transfer substrate 200 disposed is a red color donor substrate 220*a*. The red color donor substrate 200*a* includes a red colorant layer 230*a*. The red colorant layer 230*a* covers and is contacted with the workpiece substrate 300.

Next, still referring to FIG. 5A and FIG. 6, the electrothermal transfer device 100*a* is disposed on the base film 210 of the red color donor substrate 200*a* so that the electrothermal components 120 align with the first predetermined regions 310 of the workpiece substrate 300 and contact with the base film 210 of the red color donor substrate 200*a*.

Figure 5B:
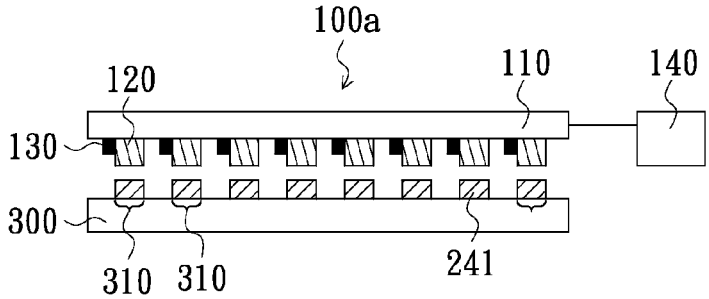

Next, referring to FIG. 5B, when the electric power source is applied to the heat circuit 130, the heat circuit 130 is configured for heating the electrothermal components 120. Thus, a plurality of portions of the heat sensitive peeling layer 220 of the red color donor substrate 200*a* corresponding to and contacted with the electrothermal components 120 are heated to be peeled from the base film 230. As a result, a plurality of portions of the red colorant layer 230*a* of the red color donor substrate 200*a* corresponding to and contacted with the electrothermal components 120 are transferred onto the workpiece substrate 300. The portions of the red colorant layer 230*a* of the red color donor substrate 200*a* are transferred on to the first predetermined regions 310 of the workpiece substrate 300, thereby forming a plurality of red filter patterns 241. Thereafter, the electrothermal transfer device 100*a* and the red color donor substrate 200*a* are moved away. That is, an electrothermal transfer process of forming the red filter patterns 241 is finished.

Figure 5C:
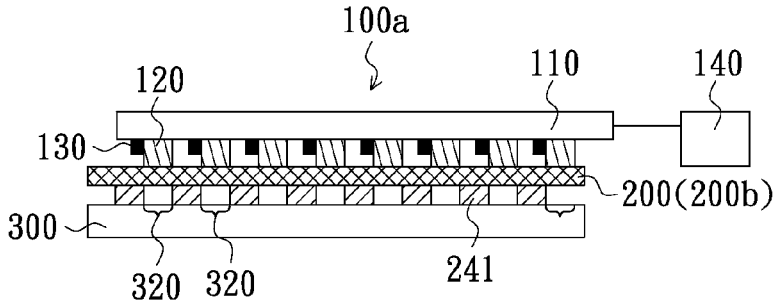
Figure 5D:
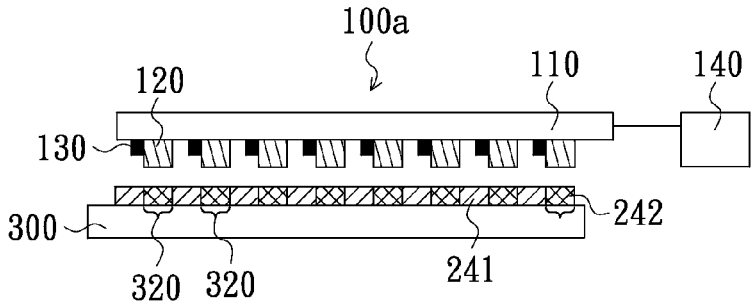

Next, referring to FIG. 5C to FIG. 5D, and further referring to FIG. 6, after the red filter patterns 241 are formed on the workpiece substrate 300, a green color donor substrate 200*b* is provided to form a plurality of green filter patterns 242 by using an electrothermal transfer process similar to the electrothermal transfer process of forming the red filter patterns 241. Similarly, the green color donor substrate 200*b* includes a base film 210, a green colorant layer 230*a* and a heat sensitive peeling layer 220 located between the base film 210 and the green colorant layer 230*a*. The green color donor substrate 200*b* is disposed on and covers the workpiece substrate 300 having the red filter patterns 241. It is noted that, the aligning unit 140 can be controlled to adjust a position of the substrate 110, thereby adjusting a relative position of the electrothermal components 120 to the workpiece substrate 300. Thus, the electrothermal components 120 can align with a plurality of second predetermined regions 320 of the workpiece substrate 300 and contact with the base film 210 of the green color donor substrate 200*b*. In the present embodiment, the second predetermined regions 320 are regions where a plurality of green filter patterns will be formed. In other words, the electrothermal components 120 are also arranged corresponding to the green filter patterns to be formed. When the electric power source is applied to the heat circuit 130, the heat circuit 130 is configured for heating the electrothermal components 120. Thus, a plurality of portions of the green colorant layer 230*b* of the green color donor substrate 200*b* corresponding to and contacted with the electrothermal components 120 are transferred onto the second predetermined regions 320 of the workpiece substrate 300, thereby forming a plurality of green filter patterns 242. Thereafter, the electrothermal transfer device 100*a* and the green color donor substrate 200*b* are moved away. That is, the electrothermal transfer process of forming the green filter patterns 242 is finished.

Next, after the red filter patterns 241 and the green filter patterns 242 are formed on the workpiece substrate 300, a blue color donor substrate can be provided to form a plurality of blue filter patterns by using an electrothermal transfer process similar to the electrothermal transfer process of forming the red filter patterns 241. The electrothermal transfer process of forming the blue filter patterns is not described here. In the present embodiment, after the blue filter patterns are formed, the color filter layer is formed on the workpiece substrate 300.

Additionally, when a color filter layer is directly formed on a displaying layer of a display device, the workpiece substrate 300 can be, for example, either a thin film transistor liquid crystal display (TFTLCD) substrate having a displaying layer or an organic light emitting display (OLED) substrate having a displaying layer.

It is noted that, the electrothermal transfer method using the electrothermal transfer device 100/100*b* is similar to the electrothermal transfer method using the electrothermal transfer device 100*a* as above described. When the electrothermal transfer device 100*b* is applied, a roll-to-roll thermal transfer process can be performed. The electrothermal transfer device 100*b* is suitable for a flexible workpiece substrate 300, for example, a plastic substrate, thereby facilitating the development of flexible components. In addition, when the electrothermal transfer device 100/100*a*/100*b* is applied, the transfer substrate 200 can be not only a color donor substrate (e.g., the red color donor substrate 200*a*, the green color donor substrate 200*b*, an so on) but also an electron or hole substrate. The electron or hole substrate can be configured for electrothermally transferring an electron layer or a hole layer. The electron or hole substrate can includes, for example, a base film, an electron or hole injection layer and a heat sensitive peeling layer between the base film and the electron or hole injection layer. During electrothermally transferring, the base film is contacted with the electrothermal components 120 and the electron or hole injection layer covers and contacts with the workpiece substrate, the heat circuit 130 is used to heat the electrothermal components 120. Thus, portions of the heat sensitive peeling layer of the electron or hole substrate corresponding to and contacted with the electrothermal components 120 are heated to be peeled from the base film. As a result, portions of the electron or hole injection layer of the electron or hole substrate are transferred onto the workpiece substrate.

In summary, in the present invention, an electrothermal transfer technology is applied. The electrothermal transfer device utilities the heating circuit to heat the electrothermal components arranged in the pattern so that the transfer substrate contacted with the electrothermal components is heated to be transferred onto the workpiece substrate. The structure of the electrothermal transfer device simple so that the electrothermal transfer device has low manufacturing cost and low maintenance cost. The electrothermal transfer method using the electrothermal transfer device can be applied to a large area thermal transfer, thereby reducing production cost.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrothermal transfer device, comprising:

a substrate having a surface;

a plurality of electrothermal components disposed on the surface of the substrate and arranged in a pattern, wherein a material of the electrothermal components is selected from a group consisting of metal, metal oxide and graphite; and a heating circuit electrically connected to the electrothermal components.

2. The electrothermal transfer device according to claim 1, wherein a material of the heating circuit is either metal or metal oxide.

3. The electrothermal transfer device according to claim 1, wherein the heating circuit is disposed on the surface of the substrate.

4. The electrothermal transfer device according to claim 1, wherein the substrate is a roller and the surface of the substrate is a circumferential surface of the roller.

5. The electrothermal transfer device according to claim 1, wherein the substrate is a plate and the surface of the substrate is a planar surface of the plate.

6. The electrothermal transfer device according to claim 1, further comprising an aligning unit connected to the substrate.

7. An electrothermal transfer method, comprising:

providing an electrothermal transfer device comprising:

a substrate having a surface;

a plurality of electrothermal components disposed on the surface of the substrate and arranged in a pattern; and a heating circuit electrically connected to the electrothermal components;

disposing a transfer substrate on a workpiece substrate;

disposing the electrothermal transfer device on the transfer substrate so that the electrothermal components contact with a plurality of portions of the transfer substrate; and heating the electrothermal components by the heat circuit so that the portions of the transfer substrate contacted with the electrothermal components are heated to be transferred onto a workpiece substrate.

8. The electrothermal transfer method according to claim 7, wherein the transfer substrate is a color donor substrate.

9. The electrothermal transfer method according to claim 8, wherein the color donor substrate comprises:

a base film contacted with the electrothermal components;

a colorant layer covering the workpiece substrate; and a heat sensitive peeling layer between the base film and the colorant layer.

10. The electrothermal transfer method according to claim 7, wherein the transfer substrate is an electron or hole substrate.

11. The electrothermal transfer method according to claim 10, wherein the electron or hole substrate comprises:

a base film contacted with the electrothermal components;

an electron or hole injection layer covering the workpiece substrate; and a heat sensitive peeling layer between the base film and the electron or hole injection layer.

12. The electrothermal transfer method according to claim 7, wherein the substrate is a roller, the surface of the substrate is a circumferential surface of the roller, and when the electrothermal components are heated by the heating circuit, the roller is rotated.

13. The electrothermal transfer method according to claim 7, wherein the substrate is a plate and the surface of the substrate is a planar surface of the plate.

14. The electrothermal transfer method according to claim 7, wherein the workpiece substrate is either a thin film transistor liquid crystal display (TFTLCD) substrate or an organic light emitting display (OLED) substrate.

15. The electrothermal transfer method according to claim 7, wherein the workpiece substrate is either a glass substrate or a plastic substrate.

16. The electrothermal transfer method according to claim 7, wherein the electrothermal transfer device further comprises an aligning unit connected to the substrate, and the electrothermal transfer method further comprises a step of controlling the aligning unit to adjust a relative position of the electrothermal components to the workpiece substrate.

17. An electrothermal transfer device, comprising:

a substrate having a surface;

a plurality of electrothermal components disposed on the surface of the substrate and arranged in a pattern; and a heating circuit electrically connected to the electrothermal components, wherein a material of the heating circuit is either metal or metal oxide.

18. An electrothermal transfer device, comprising:

a substrate having a surface, wherein the substrate is a roller and the surface of the substrate is a circumferential surface of the roller;

a plurality of electrothermal components disposed on the surface of the substrate and arranged in a pattern; and a heating circuit electrically connected to the electrothermal components.

19. An electrothermal transfer device, comprising:

a substrate having a surface;

a plurality of electrothermal components disposed on the surface of the substrate and arranged in a pattern;

a heating circuit electrically connected to the electrothermal components; and an aligning unit connected to the substrate.

* * * * *